United States Patent [19]

Heiland

[11] 4,410,884

[45] Oct. 18, 1983

[54] ALARM SYSTEM

[75] Inventor: Bernd Heiland, Telgte, Fed. Rep. of Germany

[73] Assignee: Firma Aug. Winkhaus, Telgte, Fed. Rep. of Germany

[21] Appl. No.: 932,959

[22] Filed: Aug. 11, 1978

[30] Foreign Application Priority Data

Aug. 18, 1977 [DE] Fed. Rep. of Germany ..... 2737324
Sep. 2, 1977 [DE] Fed. Rep. of Germany ..... 2739636

[51] Int. Cl.[3] ..... G08B 13/04; G08B 25/00; G08B 26/00; G08B 29/00

[52] U.S. Cl. ..... 340/545; 340/508; 340/523; 340/556; 340/691

[58] Field of Search ..... 340/545, 555, 556, 557, 340/523, 508, 541, 691

[56] References Cited

U.S. PATENT DOCUMENTS

| | | | |
|---|---|---|---|
| 2,455,780 | 12/1948 | Kohout | 340/523 |
| 2,695,994 | 11/1954 | Lode | 340/508 |
| 3,789,384 | 1/1974 | Akers | 340/523 X |
| 3,825,916 | 7/1974 | Steele et al. | 340/557 |
| 3,859,647 | 1/1975 | Ross | 340/512 |
| 3,991,415 | 11/1976 | Baar, Sr. | 340/541 |
| 4,087,814 | 5/1978 | Spirig | 343/5 PD |
| 4,131,887 | 12/1978 | Birkenhead | 340/541 X |
| 4,142,187 | 2/1979 | Nakayama | 340/554 |

FOREIGN PATENT DOCUMENTS

| | | | |
|---|---|---|---|
| 851331 | 11/1977 | Belgium . | |
| 138833 | 4/1902 | Fed. Rep. of Germany . | |
| 416000 | 7/1925 | Fed. Rep. of Germany . | |
| 1929145 | 6/1969 | Fed. Rep. of Germany . | |
| 2007840 | 9/1971 | Fed. Rep. of Germany . | |
| 2361590 | 12/1975 | Fed. Rep. of Germany . | |
| 2544400 | 7/1977 | Fed. Rep. of Germany . | |
| 2648631 | 3/1978 | Fed. Rep. of Germany . | |
| 36399 | 12/1961 | German Democratic Rep. . | |
| 2293018 | 11/1975 | France . | |
| 1160496 | 7/1968 | United Kingdom . | |
| 2002939 | 2/1979 | United Kingdom | 340/523 |

OTHER PUBLICATIONS

Sueddeutsche Zeitung, No. 164, Dated Jun. 19, 1973, Entitled "Mankind and Technology".
Publication Entitled Elektronic, 1970, Issue 2, p. 60.

*Primary Examiner*—John W. Caldwell, Sr.
*Assistant Examiner*—Joseph E. Nowicki
*Attorney, Agent, or Firm*—Toren, McGeady & Stanger

[57] ABSTRACT

An Alarm system for furnishing an alarm signal in response to unauthorized entry through a passage connecting the outside to the interior of a building, wherein a first detecting device furnishes a first output signal when sensing the presence of a person in a first portion of the passage. A second detecting device nearer the outside of the building furnishes a second output signal when sensing the approach of a person. An evaluating circuit receives the output signals and initiates an alarm signal only if the second output signal is furnished prior to the first output signal.

29 Claims, 10 Drawing Figures

ALARM SYSTEM

The invention relates to an alarm system for securing a passage, particularly a window or a door in a house, including a central station equipped with several channels capable of being triggered independently from each other, at least one detector for each channel, and an alarm device and/or a remote alarm signalling device, the detector of a first channel securing the passage.

It is known to secure the windows or doors of a house by means of such an alarm system. The alarm is triggered when the passage is traversed while the alarm system is activated. To permit certain detection of unauthorized entry, the sensitivity of such alarm systems must be relatively high. However, false alarms are often given under these conditions, particularly if persons present in the house although the alarm is switched on walk through the passage unintentionally or trigger the detector of the passage.

It is the object of the invention to improve an alarm system employed for securing a passage in a house, particularly for securing a window or a door, in such a manner that the hazard of a false alarm being released by a person present in the house is largely eliminated even at high sensitivity.

With reference to an alarm system of the type discussed in more detail in the introductory paragraph, this object is achieved in that the detector of a second channel is arranged ahead of the detector of the first channel in a direction toward the interior of the house, that the first and second channels are connected to an evaluation circuit which triggers the alarm device or the remote alarm indicating arrangement when the detector of the second channel is triggered at a point in time prior to the detector of the first channel, and which does not trigger the alarm device or the remote alarm signalling device when the detectors of the first and second channels are triggered in inverted time sequence.

Thus, the alarm is triggered when the detectors of both channels are released sequentially in the secured direction, that is, during entry into the house to be secured. A false alarm by accidental release of one of the two detectors is thus avoided. But a false alarm is avoided also if persons present in the house move through the passage in a direction opposite to the secured direction, as by leaning out of a window secured by the alarm system, or by walking out of the house through a secured door. It is an advantage of the alarm system of the present invention that it may remain activated when persons are present in the house secured by the alarm system.

The two detectors, which are preferably light barriers, may be arranged on opposite sides of the passage, for example, on the inner side and the outer side of the window or the door. The alarm is triggered in this instance when the detector arranged on the outside of the passage is triggered prior to the detector arranged on the inside. It is preferred to arrange several light barriers at both sides of the window or door which may be placed in a plane parallel to the surface of the window or the door because such arrangements are more difficult to circumvent. Light barriers have significant additional advantages for securing windows or glazed doors. It was customary heretofore to employ glass breakage indicators for securing windows and glazed doors. The indicators were glued or cemented to the glass pane at a distance from the frame and converted the oscillating energy during fracture of the glass pane into an alarm triggering signal. Such glass breakage indicators have several disadvantages. Their ability to function depends on their mounting on the glass pane and is not capable of reliable testing. They require freely suspended leads to the movable window or door panel and interfere with appearance. They hamper cleaning of the glass pane. Moreover, an alarm can be triggered by a glass breakage indicator only once, that is, during fracture of the glass pane. The light source and light receptor of the light barrier may be installed, for example, in conforming hollow shapes on both sides of the frame or in the wall structure.

It has also been found advantageous when the signal of the detector mounted on the inside of the passage and the signal of a contact switch detector responding to the opening of a panel of a window or a door which constitutes the passage are connected by an OR-gate. In this way the triggering reliability of the alarm system in response to opening of the window or the door from the outside can be enhanced substantially. The window or door, however, still can be opened from the inside without triggering an alarm.

When light barriers are employed for securing windows and doors, the light beam of the light barrier is preferably led past the closing handle of the window or door at a short distance therefrom. In this case, too, persons present in the house may open the window or door from the inside without the alarm being triggered because the outer light barrier cannot then be actuated first.

Embodiments of the invention in which at least one of the detectors of the first channel secures the outer shell of the house and at least one of the detectors of the second channel secured to surroundings of the house also are of substantial importance. Such alarm system respond already to an approach to the house and permit several defensive measures. For example, the second channel may switch on the external illumination of the house through a switching arrangement. Aside from the deterrent effect of the external illumination being switched on, there is obtained a beneficial side effect: when inhabitants of the house come home in the dark, the external lights of the house are switched on automatically.

On the other hand, an alarm device perceptible only within the house may be connected to the second channel and be switched on when one of the detectors of the second channels is released. It is an advantage of this arrangement, that the persons present in the house are given an alarm upon approach, but not third parties, especially the neighbors or the police. Switching on of alarm devices, such as an alarm siren, is thus delayed until the first channel also is released thereafter.

Such alarm systems thus are relatively safe against false alarms. The response sensitivity of both channels may be relatively high, the response sensitivity of the second channel, which secures the surroundings, being preferably higher. Detectors which may be employed with the second channel may thus be radar area monitoring sensors, directed outward of a window, or passive infrared monitors, mounted outside the house to survey open country, or pressure monitors inserted in the ground in front of the house. Buzzers, bell, etc. may be provided as alarm devices for the second channel within the house.

An evaluating circuit of the simplest type includes a flip flop circuit with a set input to which the detector first to be released for triggering the alarm is coupled. The detector to be released thereafter is coupled to the clock input of the flip flop circuit. This arrangement makes use of the fact that such a flip flop circuit is set only when the signal fed to the set input occurs sooner than the signal at the clock input, at the latest however together with that signal. The detector to be released first is preferably coupled to the set input by a monostable multivibrator. In this manner, the flip flop circuit can be triggered even when the signal of the detector coupled to the set input has already ceased. The monostable multivibrator is preferably a retriggerable monostable multivibrator which may be set again even before expiration of its time constant.

The light barriers may be of any desired kind. Light barriers having modulated light beams are preferred for reasons of reliability. Such a light barrier may include an oscillator connected with at least one light emitter, and a comparator connected with at least one light receptor for controlling an alarm device, the first input of the comparator being connected with the light receptor, and the second input with the oscillator. The oscillator in the simplest case is a free running multivibrator which modulates or controls the light emitter. The comparator compares the signal of the oscillator with the signal received from the light receptor. The alarm is triggered when the emitted and the received information do not agree. A delay circuit may be inserted between the oscillator and the second input of the comparator to compensate differences in signal transit time. Residual differences in transit time may be compensated by means of an integrator, for example, a low-pass filter. Pulse shaper stages are preferably arranged ahead of both inputs of the comparator. For further increasing reliability against false alarm and the influence of external light, the oscillator may be frequency or pulse modulated. The current requirement of the alarm indicator may be reduced by suitable selection of the on/off ratio in the event of pulse modulation. By way of example, the average current requirement is reduced by approximately 80% with a pulse modulation of 1:10. Further to reduce the energy required, a multiplexer may be provided for connecting the light emitters to the oscillator in continuous sequence, one after the other. In this event, a demultiplexer synchronized with the multiplexer must be provided for controlling the light receptors, which connects a light receptor with the comparator whenever the associated light emitter is connected with the oscillator. The lines connecting the central station to the detectors and the alarm devices preferably consist of multi-conductor cables or lines, particularly ribbon cables, and a sabotage sensing stage is connected to at least one of the conductors and responds to changes in a potential applied to the one conductor or in the current flowing through the conductor when the conductor is severed. This specific embodiment is based on the fact that all wires of the connecting line, including the wire connected to the sabotage sensing stage are usually cut or short-circuited for making the alarm arrangement inoperative. Refinements which respond already to the destruction of any individual wire in the connecting line include sub-stations for the passages of the house that are to be secured. As will be explained hereinbelow, the sub-stations are scanned in a main central station as to whether a preliminary alarm, a principal alarm, or a sabotage alarm is being triggered. The sabotage alarm is triggered when a signal normally present at the time of scanning and generated in the scanned sub-station only with the connecting lines intact, is not received by the main central station.

The sabotage sensing stage preferably triggers an alarm capable of being sensed in the house only. In this manner, triggering of the main alarm is prevented if one of the connecting lines is severed unintentionally by inhabitants of the house. To permit triggering of the main alarm of the first channel during intentional, unauthorized severing of the connecting line by a burglar, provisions may be made that the first channel be triggered when the sobatage sensing stage and the second channel are jointly triggered.

In embodiments having substantial importance, the central station is divided into a main central station to which the alarm devices or the remote alarm indicating apparatus is connected, and several branch stations each of which secures one passing of the house. The branch stations are preferably arranged in the area of the passage and periodically rendered operative in predetermined sequence. They may be rendered operative in such a manner that a calling circuit transmits code signals from the main central station to the branch stations which code signals prepare the branch stations for furnishing alarm signals when the detectors of the so-prepared branch station are triggered. In a preferred embodiment, however, provisions are made that the branch stations are blocked and are rendered operative only by enabling signals of the branch station preceding in the predetermined sequence.

It is an advantage of such embodiments that the number of detectors can be increased without difficulty and that each branch station may be adapted particularly to the detectors connected therewith. Additionally, the branch stations whose detectors have triggered a preliminary alarm, a main alarm, or a sabotage alarm, may be indicated optically in the main central station.

The invention is to be explained in more detail with reference to drawings in which.

Figure 2:
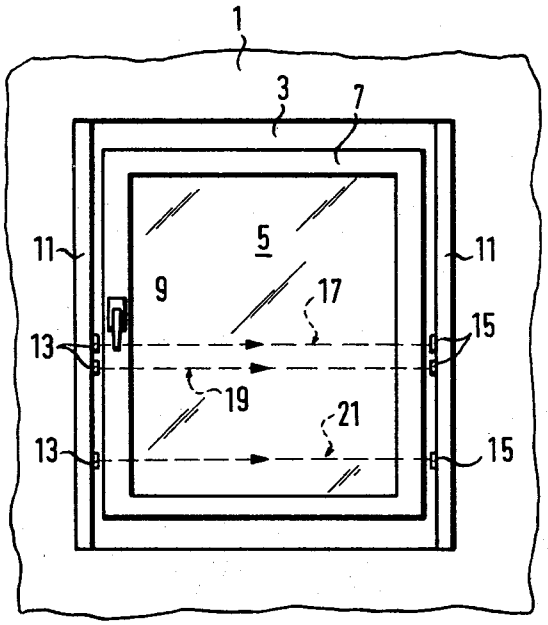
FIG. 2 is a top plan view of the inside of the window according to FIG. 1.
Figure 1:
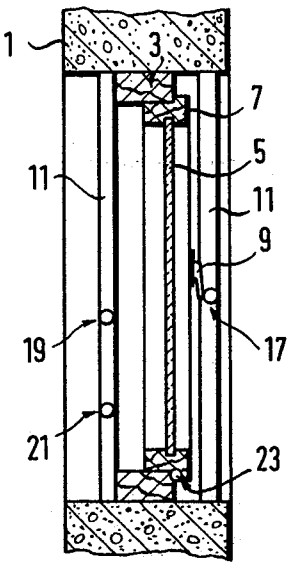
FIG. 1 shows a cross section of a window secured by light barriers of an alarm arrangement according to the invention.

In FIGS. 1 and 2, there is illustrated schematically a window having a frame 3 anchored in masonry 1, a casement 7 including a glass pane 5 and hinged to the frame 3, and arranged to be opened or closed by means of a grip or closing handle 9. Hollow sections 11 are conformingly connected with the frame 3 and the masonry 1 respectively on both sides of the frame 3, both on the inside of the window located at the right in FIG. 1, as on the outside of the window. The hollow sections 11 contain light emitters 13 or light receptors 15 of light barriers 17,19,21 whose light beams are represented in FIG. 2 by broken lines. The light barrier 17 is arranged on the inside of the window, its light beam being led contiguously past the closing handle 9 and being interrupted when the closing handle 9 is operated. The light beams of the light barriers 19, 21 are arranged on the outside of the window in spaced relationship to each other and shield the outside in a grid pattern. A contact 23, such as a magnet contact, is arranged in a rabbet between the frame 3 and casement 7 and responds to opening of the casement 7.

Figure 3:
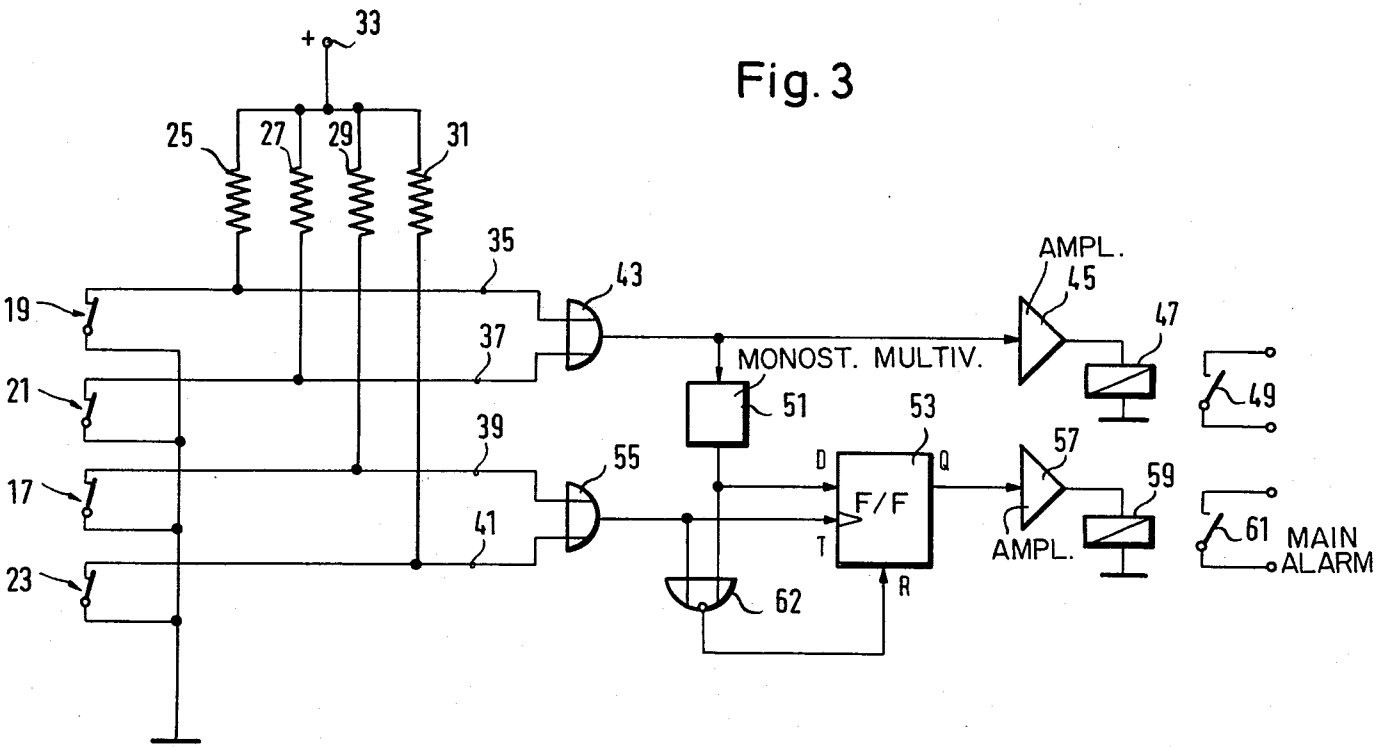
FIG. 3 is a schematic block diagram of a first exemplary embodiment of the alarm arrangement.

FIG. 3 shows a block diagram of an evaluating circuit which triggers the alarm. The light barriers 17,19,21 and the contact 23 are represented as normally closed contacts for the sake of simplicity. These contacts may be relay contacts of control stages of the light barriers. The contacts are opened when the light beam of the light barrier is interrupted or when the window casement stands open. The contacts are arranged between the positive terminal 33 of a voltage source and the negative terminal which is connected to ground in respective series connections with resistors 25,27,29,31. Output lines 35,37,39,41 therefor are at zero potential when the contact is closed, and at a signal corresponding to logic level 1 when it is open. The output lines 35,37 of the two light barriers 19,21 outside the window are connected with an OR gate 43 or its functional equivalent which controls a relay 47 by way of an amplifier 45. An alarm device (not shown) noticeable only within the house is connected to the contact 49. When only the light beams of the light barriers 19,21 are interrupted, the alarm triggered thereby is noticeable only within the house.

The main alarm is triggered only when, after triggering of the preliminary alarm by the light barriers 19,21, the light beam of the light barrier 17 is interrupted or the contact 23 is opened by opening of the window. The preliminary alarm triggering signal available at the output terminal of the OR gate 43 sets a temporary storage device, such as a monostable multivibrator 51 whose output terminal is connected with the set input D of a flip flop 53. However, the flip flop 53 is set only if additionally a release signal of the internal light barrier 17 or of the rabbet contact 23 is fed to its clock input terminal T. The output line 39,41 of the light barrier and rabbet contact 23 respectively are connected by an OR gate 55 or its functional equivalent with the clock input T. The output terminal Q of the flip flop 53 is connected by an amplifier 57 with a relay 59 whose contact 61 triggers the main alarm of the alarm arrangement when the flip flop 53 is set. For resetting of flip flop 53, its reset input R is connected to the output of a NOR gate 62 whose inputs are connected to the output of monostable multivibrator 51 or of OR gate 55 and which can determine in this manner whether all normally closed contacts of light barriers 17 through 21 and of contact 23 are again closed.

Figure 4:
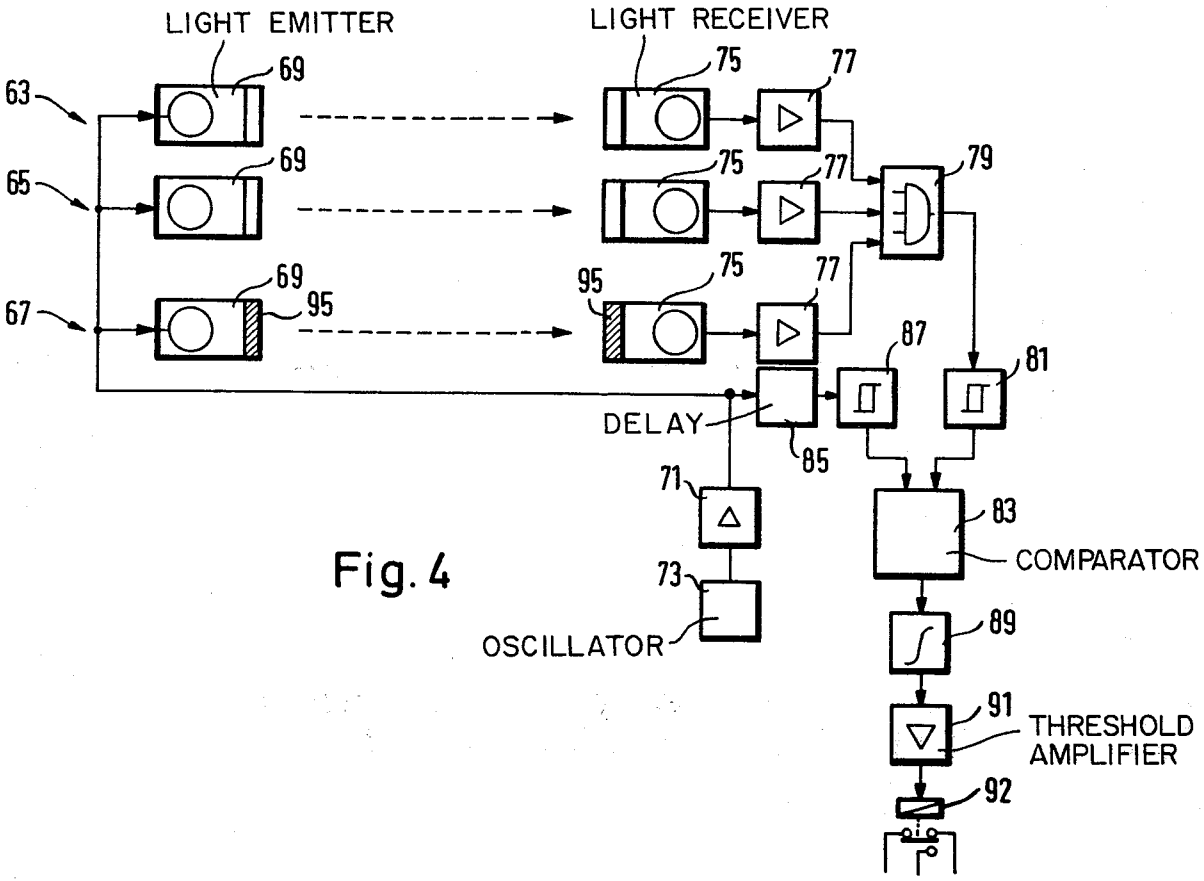
FIG. 4 is a schematic block diagram of a first exemplary embodiment of a multiple light barrier suitable for use in the alarm arrangement.

FIG. 4 shows a schematic block diagram of a light barrier grid with a plurality of light barriers 63, 65, 67 which, similar to light barriers 19, 21 of FIG. 1 are used to secure the surface of a passage. The arrangement according to FIG. 1 generates an alarm triggering signal when the light beam of one of light barriers 63, 65, 67 is interrupted. Each light barrier 63, 65, 67 has a light emitter 69 which is energized with rectangular pulses by an oscillator 73, for example a free running multivibrator, via an amplifier 71. A light receiver 75 is assigned to each light emitter 69. The output of each light receiver 75 is applied to an AND gate 79 through an amplifier 77. AND gate 79 is connected through a pulse former stage 81 to one input of a comparator 83 to whose other input the output signal of amplifier 71 is applied through a delay stage 85 which compensates for differences in transit time and a further pulse former stage 87 connected after delay stage 85. Comparator 83 determines whether pulse former stages 81, 87 furnish pulses simultaneously. As long as at least one of the light beams of the light barriers is interrupted, AND gate 79 blocks and comparator 83 generates an alarm triggering system. An integrator 89, for example a low pass filter, is connected to the output of comparator 83 for compensating for residual transit time differences. Integrator 89, through a threshold amplifier 91 energizes relay 92 which, for example, controls the alarm system. Incandescent lamps, light emitting diodes, etc. are suitable as light sources for light emitter 69. Photo diodes or phototransistors or such like can be used as light receiver 75. Light emitter 69 and light receiver 75 may operate in the region of nonvisible light and have appropriate filters 95.

Figure 5:
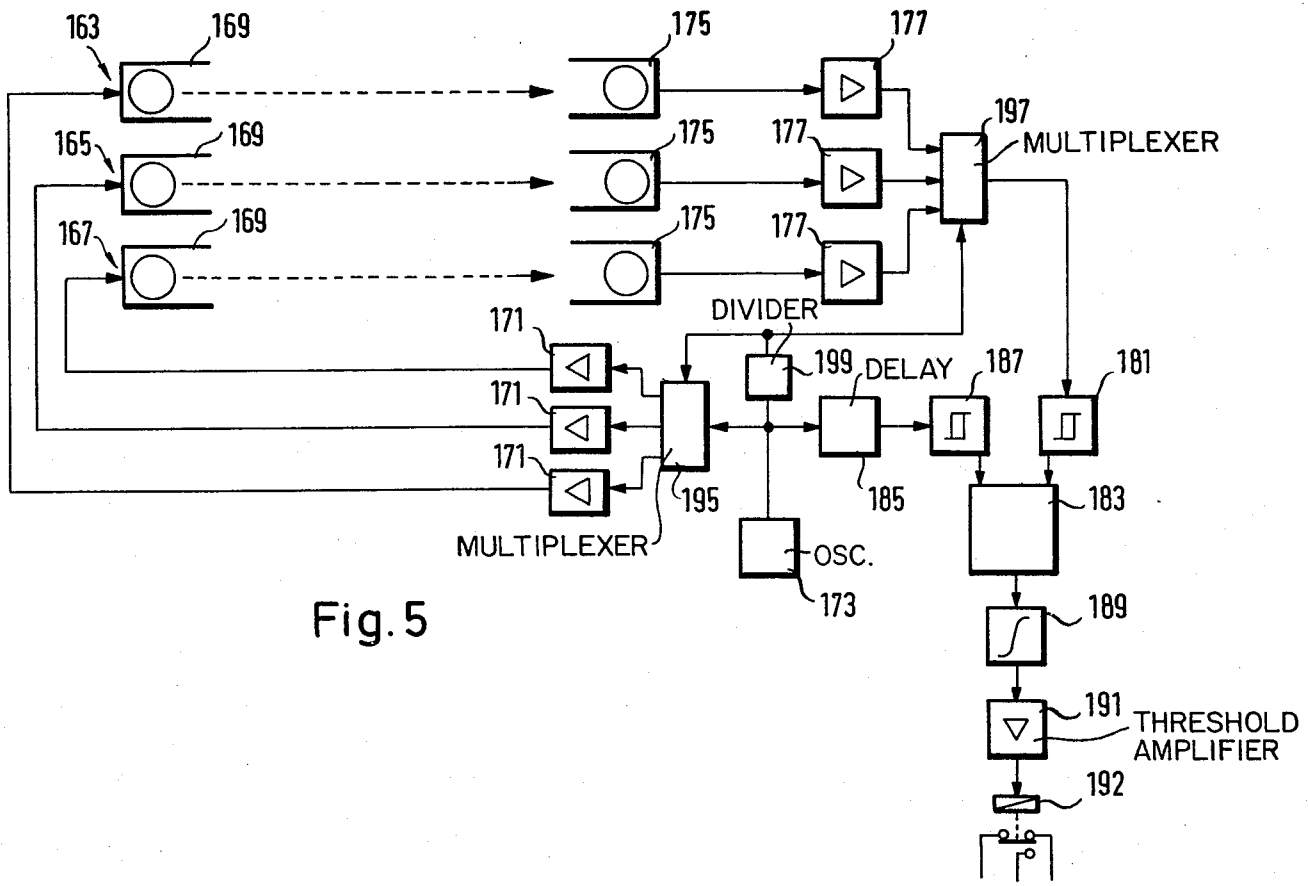
FIG. 5 is a schematic block diagram of a second exemplary embodiment of a multiple light barrier suitable for use in the alarm arrangement.

FIG. 5 shows an embodiment of a light barrier grid which requires less energy. For explanation of its operation reference is made to FIG. 4, the reference numerals of similarly operating elements being increased by the number 100. The substantial difference relative to the embodiment of FIG. 4 is, that oscillator 73 energizes light emitters 169 of light barriers 163, 165, 167 through a multiplexer 195 sequentially with respect to time in a sequence which remains the same. Light emitters 169 are connected through amplifiers 171 to multiplexer 195. Light receivers 175 of light barriers 163, 165, 167 are connected through amplifiers 177 to a demultiplexer 197 which is energized jointly with multiplexer 195 and synchronously with it by oscillator 173 for example through a 1:10 divider 199. Multiplexer 195 and demultiplexer 197 switch light emitters 169 and light receivers 175 of the individual light barriers 163, 165, 167 to the operative stage in sequence. The output signal of demultiplexer 197 is connected through pulse former stage 181 to the one input of comparator 183. The other input of comparator 183 is again connected through delay 185 and pulse former stage 187 to oscillator 173. In correspondence with FIG. 4, integrator 189 which is connected to comparator 183 again controls relay 192 through threshold amplifier 191.

Figure 6:
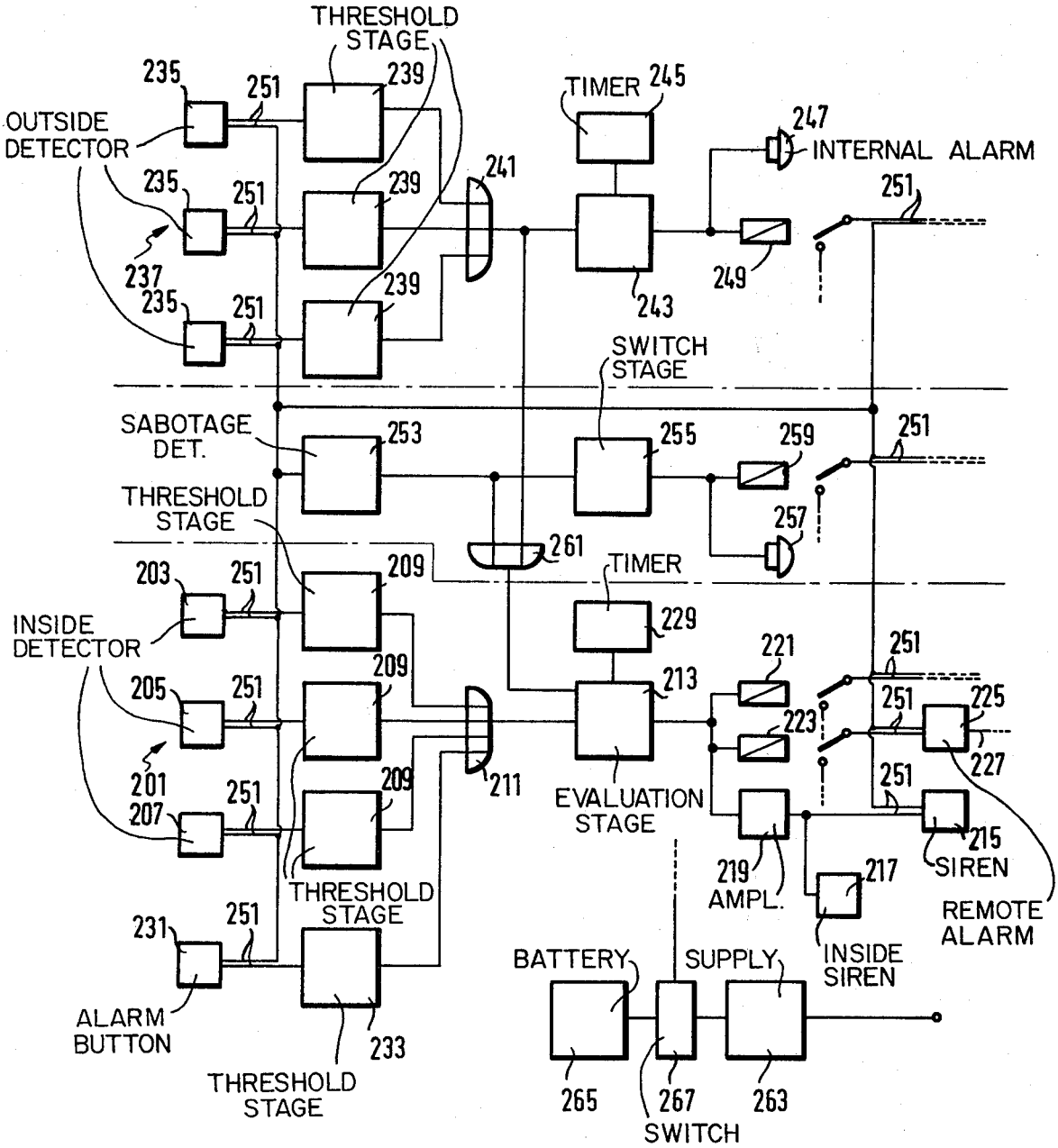
FIG. 6 is a schematic block diagram of a second exemplary embodiment of an alarm arrangement.

The embodiment shown in FIG. 6 shows a first channel 201 with detectors 203, 205, 207 which secure the outer surface of a house, for example at the doors and windows. Detectors 203, 205, 207 may, for example, be embodied in vibration sensors or glass breakage sensors. Instead of glass breakage sensors which may signal the destruction of the glass pane, that cannot be retriggered for a new intrusion, light barriers could be used which trigger the alarm for each interruption of the light beam. Securing the outside of the house has the advantage that the inhabitants can move freely within the house without triggering the alarm.

A threshold stage 209 is connected to each of the detectors 203, 205, 207. Threshold stage 209 determines the response sensitivity of the detectors and may if necessary include an amplifier or can be a single building block together with the detector. Threshold stages 209 are each connected to one input of an OR gate 211, whose output is connected to a switching state 213 (evaluation circuit). Switching stage 213 triggers the alarm system of channel 201 when one of the detectors 203, 205, 207 responds and previously a second channel 237 of the alarm system which secures the surroundings of the house and will be explained in greater detail below has been released. A siren 215 which can be heard outside of the house as well as a siren 217 which sounds within the house are provided as alarm devices, both being energized by a siren amplifier 219 controlled by switching stage 213. Loud speakers can be used instead of sirens 215, 217, if siren amplifier 219 is constructed as a tone generator. Further connected to switching stage 213 are relays 221, 223 through which further alarm devices (not shown) or a remote alarm generating device 225 can be triggered. The remote alarm device 225 triggers an alarm device located with a third party, for example the police through a telephone line 227. A timing generator 229 is connected to switching stage 213. The timing generator delays the triggering of the alarm devices as well as limiting the time during which the alarm is sounded. In order that the alarm of channel 201 can be triggered independently of detectors 203, 205, 207, an intrusion reporting line is provided over whose push button switches of which only one is shown at 231, the alarm of channel 201 may be triggered. Push button switch 231 is connected through a switching or matching stage 233 similar to threshold stages 209 to the input of OR gate 211. Help can therefore be obtained by activation of push button switch 231 in case, for example, of an assault.

Besides channel 21, the alarm system has the previously mentioned second channel 237 which can be triggered independently of channel 201 through detectors 235. Threshold stages 239 which, in construction and function correspond to threshold stages 209 are connected to detectors 235. Corresponding to channel 201, threshold stages 239 are connected through an OR gate 241 to a switching stage 243 similar to switching stage 213, which in turn is connected to a time generator 245. The operation of time generator 245 corresponds to that of time generator 229 of channel 201. The switching stage controls an alarm 247 which can be detected solely within the house, for example a buzzer or a bell, as well as a relay 249 whose contacts, for example, control the external illumination of the house.

Detectors 235 secure the surroundings of the house. Their associated threshold stages 239 are set to a higher response sensitivity than are the threshold stages 209 of first channel 201. Even though the higher response sensitivity of second channel 237 may result in the generation of a false alarm, the inhabitants of the neighborhood are not alarmed by a siren 215. Only the inhabitants of the house secured by the alarm system are alarmed through alarm device 247 and can, if necessary, obtain help through push button switch 231 of the intrusion reporting line.

Detectors 203, 205, 207 and 235, push button switches 231, siren 215, the remote alarm device 225 and if necessary all further alarm devices are connected to the central station of the alarm arrangement through a multiconductor cable 251. At least one conductor of the conductors of this connecting cable which in particular may be ribbon conductors, is connected in the central station to a sabotage recognition stage 253 which responds when this conductor is broken. The sabotage recognition stage can detect changes in the current flowing in this conductor, or else it can respond to voltage changes in the voltage applied to this conductor. The conductor serving as a sabotage detector can be a ring conductor slipped through all detectors and alarm devices. These conductors are necessarily severed at severing of connecting cables 251. The sabotage recognition stage 253 triggers an alarm device 257 through a switching stage 255, the alarm device being perceptible only within the house, that is a buzzer or such like. Further connected to switching stage 255 is a relay 259 over whose contacts further alarm devices or the external illumination of the house is controlled. In order to be able to trigger the alarm of channel 201, the sabotage recognition stage is connected to one input of an OR gate 261, whose output is connected to switching stage 213. The other input of OR gate 261 is connected to the output of OR gate 241 of channel 237. The alarm of channel 201 is thus only triggered when either the sabotage recognition stage 253 or channel 237 are triggered.

The current supply of the alarm system is only suggested. It takes place either through a circuit 263 or from a battery 265, a switching arrangement 267 automatically switching to battery operation upon interruption of circuit voltage.

Figure 7:
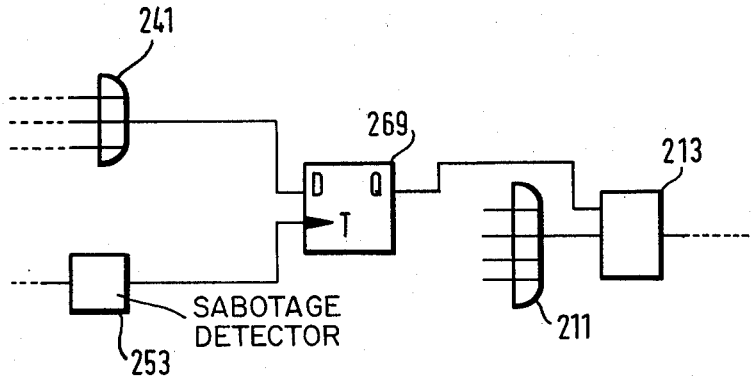
FIG. 7 is another embodiment of a circuit detail in the block diagram of FIG. 6.

FIG. 7 shows a suitable variation of the alarm system of FIG. 6. Instead of OR gate 261 in FIG. 6, a D flip flop 269 is provided whose set input "D" is connected with OR gate 241 which furnishes the trigger signal or second channel 237 and whose clock input "T" is connected to the sabotage recognition stage 253. The "Q" output of flip flop 269 is connected to the switching stage 213 of first channel 201. Flip flop 269 triggers switching stage 213 only if channel 237 has been triggered first through one of its detectors 235 and then the sabotage recognition stage 253 was triggered. This has the advantage that accidental triggering of sabotage recognition stage 253, that is during accidental interruption of one of the connecting lines 251, the main alarm of channel 1 is not triggered even if someone approaches the house shortly afterwards. The circuit of FIG. 7 has an even higher false alarm prevention capability.

Figure 8:
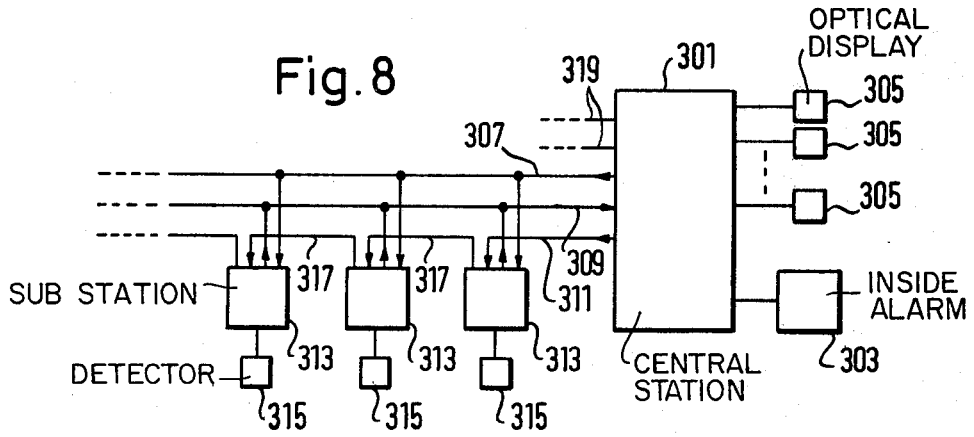
FIG. 8 is a block diagram of an alarm arrangement for securing several passages of a house.

FIG. 8 shows a block diagram of an alarm system for securing a number of passages of a house. The alarm arrangement comprises a main central station 301, to which are connected alarm devices for a pre-alarm perceptible only within the house, for example a buzzer or a lamp, as well as for a main alarm, for example a siren are connected. These are represented as block 303. The pre-alarm is triggered when, as is described in the embodiment above, only one detector of the passage is triggered or else when the detectors securing the passage are triggered in a direction opposite the direction to be secured. The main central station 301 has optical indicating devices 305, each being assigned to a passage to be secured and which, for a pre-alarm, a main alarm, or a sabotage alarm, indicate the passage for which the alarm has been triggered.

Connected to main station 301 through line 307, 309 and 311 are substations 313, of which each is assigned to one of the passages of the house. Connected to substations 313 are detectors securing the passage and indicated schematically at 315. The substations 313 include the evaluation circuits which have been previously explained in greater detail, by the aid of which distinctions between pre-alarm, main alarm and sabotage alarm can be made.

Substation 313 are interrogated in a sequence which always remain the same, as to whether an alarm has been triggered at detectors 315. For this purpose a rectangular pulse is applied through a line 307 to all substation 313, the rectangular pulse synchronizing the operation of the substations 313 with one another. As will be explained in greater detail below, the substations have a control device which enable them to furnish alarm signals for a predetermined number of rectangular pulses following receipt of enabling signals. The enabling signal of the first substation 313 in the predetermined sequence is supplied from main station 301 through line 311. Each of substations 313 is connected through a line 317 with the next following substation 313 in the predetermined sequence and generates the enabling signal for the next substation 313 on this line 317. If the detectors 315 of substation 313 are triggered while the substation 313 is enabled, the alarm signal is transmitted through line 309 to central station 301 where it triggers alarm device 303. From the position within the predetermined sequence it can be determined, at which of substation 313 the alarm has been triggered, whereby the corresponding indicator device 305 is activated. Additional parallel lines may be put down next to lines 307 to 311, for example lines 319 for the current supply for substation 313.

Figure 9:
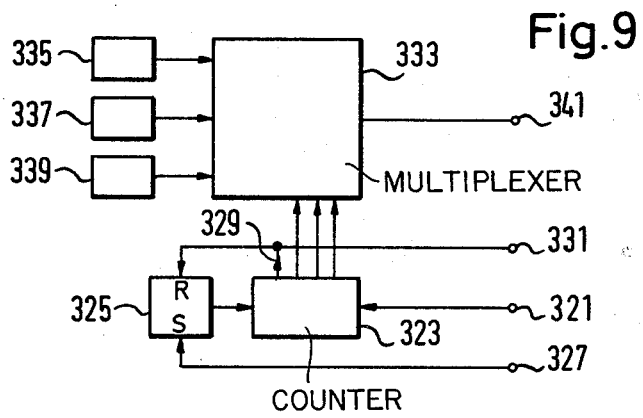
FIG. 9 is a schematic block diagram of a branch station of the alarm arrangement according to FIG. 8.

FIG. 9 shows the details of a substation. The square wave signals applied through line 307 are applied at 321 to the counting input of a counter 323 which, through a flip flop 325, is enabled to count the square wave pulses or is blocked and reset in accordance with the state of the flip flop. Flip flop 325 enables counter 323 when an enabling signal of the previous substation in the predetermined sequence or of the main station is applied to it at a terminal 327. Each time, counter 323 counts a predetermined number of the square wave pulses applied at terminal 321. When a predetermined number is reached, counter 323 furnishes a signal at an output 329, which switches flip flop 325 to the other state and further is applied through a terminal 331 as an enabling signal to the next subsequent substation 313 in the predetermined sequence. After the predetermined count has been reached flip flop 325 blocks the counter or resets it. Counter 323 controls a multiplexer 333 which connects a pre-alarm recognition stage 335, a main alarm recognition stage 337 as well as a sabotage alarm recognition stage 339 sequentially in a sequence which remains the same to an output terminal 341 to be connected to line 309. During the period in which the substation is enabled, the types of alarm are therefore scanned sequentially, the type of alarm being determined in the main station from the time sequence.

Figure 10:
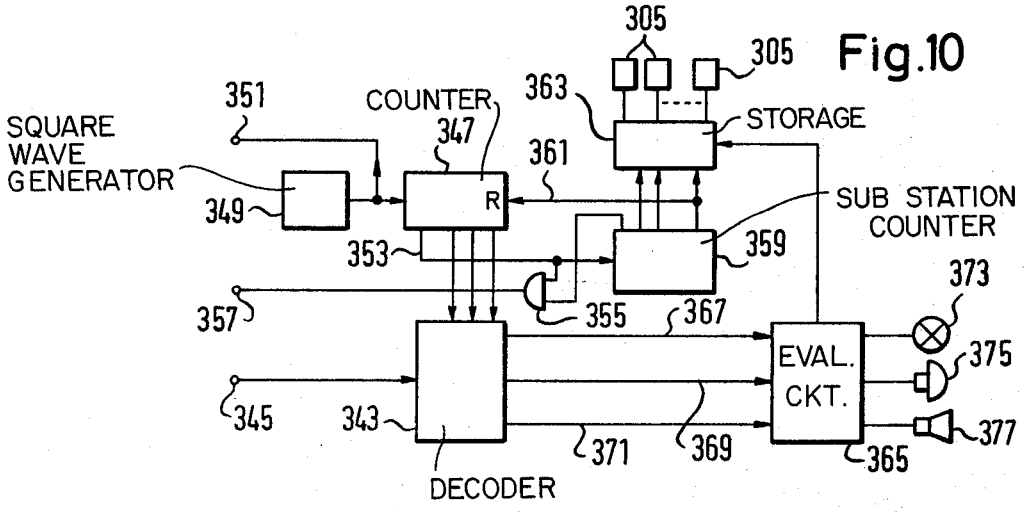
FIG. 10 is a schematic block diagram of a main central station of the alarm arrangement according to FIG. 8.

As shown in FIG. 10, a demultiplexer 343 is provided for this purpose in the main station, the input terminal of demultiplexer 343 being connected through line 309 with the output terminal 341 of multiplexer 333 in the substation. Demultiplexer 343 is controlled by a counter 347 which counts rectangular pulses furnished by a rectangular pulse generator 349. The output of rectangular pulse generator 349 is also connected to an output terminal 351 of main station 301 which is meant for connection to line 307. In correspondence to counter 323, counter 347 furnishes a signal at a terminal 353 when at a predetermined count and, through an AND gate 355, also furnishes an enabling signal at an output terminal 357. The first substation 313 scanned in the predetermined scanning sequence is connected through line 311 to output terminal 357. In order that only one enabling signal be generated for each scanning cycle, the signals furnished at the output 353 by counter 347 are counted in a second counter 359 whose counting capacity is equal to the number of substations 313 or, at least, is so set that counter 359 when reaching a count corresponding to the number of substations 313 presets counter 347 through a line 361 to an appropriate predetermined count. The count on counter 359 corresponds to the position of the then-activated substation 313 within the scanning cycle. The outputs of counter 359 are connected through a storage 363 to indicating devices 305. Storage 363 only enables indicator device 305 to indicate an alarm when the enabled substation 313 indicates an alarm. Whether this is the case is determined by means of an evaluation stage 365 which is connected to the outputs of demultiplexer 343. Evaluation circuit 365 responds when signals appear at one of the outputs 367, 369 and 371 enabled sequentially with respect to time by demultiplexer 343 which indicates the triggering of a pre-alarm, a main alarm or a sabotage alarm. The alarm devices assigned to the individual types of alarms, for example a warning lamp 373, a buzzer 375 and a siren 377 are connected to evaluation stage 365.

Preferably, the alarm recognition stages 335, 337 and 339 of substation 313 are so constructed that the pre-alarm recognition stage 335 and the main alarm recognition stage 337 normally do not furnish a signal and furnish an alarm signal only in case of an alarm, while the sabotage recognition stage 339 normally furnishes a signal which is absent in case of an alarm. This arrangement of the signals has the advantage of greater immunity to interference. When one of the lines to the substation is severed or if one of the substations falls, the signals from the output of the sabotage recognition stage are absent when the substation is scanned, thereby generating the sabotage alarm. The sabotage alarm can be furnished by the alarm generators of the pre-alarm. Preferably, the main alarm is triggered when a pre-alarm is triggered by one of the detectors prior to the sabotage alarm.

I claim:

1. In a building having an interior and an exterior, and at least one passage connecting said interior to said exterior, an alarm system for furnishing an alarm signal in response to unauthorized entry through said passage, comprising: first detector means located in the first predetermined position in said passage for sensing the presence of a person in the operative vicinity of said first detector means and furnishing a first detector output signal in response to a so-sensed presence; second detector means located in a second predetermined position preceding said first predetermined position in the direction from said exterior to said interior of said building for sensing the presence of a person in the operative vicinity of said second detector means and furnishing a second detector output signal in response to a so-sensed presence; and evaluation circuit means connected to said first and second detector means, for furnishing said alarm signal only if said second detector output signal is furnished prior to said first detector output signal, and alarm means for furnishing one alarm within the building in response to said second detector output signal and one alarm outside the building in response to said alarm signal, said alarm means and said evaluation circuit means being arranged to inhibit an alarm outside the building if only the first detector output signal is furnished and if the first detector output signal is furnished prior to the second detector output signal.

2. An alarm as set forth in claim 1, wherein said passage has an interior side and an exterior side constituting, respectively, said first and second predetermined positions.

3. An alarm system as set forth in claim 2, wherein said first and second detector means comprise, respectively, first and second photoelectric detector means.

4. An alarm system as set forth in claim 3, further comprising passage blocking means in said passage, said passage blocking means having an open and a closed position; wherein said first detector means further comprises contact means having an open and a closed position corresponding, respectively, to said open and closed position of said passage blocking means, and OR gate means having a first input connected to said first photoelectric means, a second input connected to said contact means and an output for furnishing said first detector output signal.

5. A system as set forth in claim 3, wherein said building further has passage blocking means having an open and a closed state respectively opening and blocking said passage, said passage blocking means having a handle; further comprising first and second light emitting means for, respectively, transmitting a first and second light beam to said first and second photoelectric detector means; and wherein said first light emitting means and said first detector means are positioned in such a manner that said first light beam passes at a short distance from said handle.

6. A system as set forth in claim 1 wherein said first predetermined position is at said exterior of said building and said second predetermined position is in the surroundings of said building.

7. An alarm system as set forth in claim 5, further comprising illuminating means for illuminating said exterior of said building, and light activating means connected to said illuminating means and said second detector means for activating said illuminating means in response to said second detector output signal.

8. A system as set forth in claim 1, wherein at least one of said detector means comprises a plurality of light emitting means each for emitting a light beam when enabled, and a plurality of light receiver means each for receiving a light beam from a corresponding one of said light emitting means and furnishing a "received light" signal in response thereto, oscillator means connected to said light emitting means for furnishing oscillator output signals enabling said light emitting means, and comparator means connected to said light receiver means and said oscillator means for comparing said oscillator output signals and said "received light" signals and furnishing said first detector output signal upon receipt of an oscillator signal in the absence of a "received light" signal.

9. A system as set forth in claim 8, wherein said oscillator means comprises means for furnishing oscillator output signals each for simultaneously enabling all of said light emitting means; further comprising AND gate means connected between said plurality of light receiver means and said comparator means for furnishing an AND gate output signal to said comparator means only upon simultaneous receipt of all of said "received light" signals.

10. A system as set forth in claim 8, wherein said oscillator means comprises means for enabling said plurality of light emitting means in a predetermined sequence thereby creating "received light" signals in a corresponding sequence at said light receiver means; and wherein said comparator means comprises means for comparing "received light" signals from each of said light receiver means to said oscillator output signals.

11. A system as set forth in claim 10, further comprising delay means interconnected between said oscillator means and said comparator means for delaying said oscillator output signals prior to application to said comparator means.

12. A system as set forth in claim 11, wherein the one of said detector means further comprises integrator means connected to said comparator means for integrating said comparator output signal and furnishing a corresponding integrated signal, and threshold circuit means connected to said integrator means for furnishing said first detector output signal only when said integrated signal exceeds a predetermined threshold amplitude.

13. A system as set forth in claim 10, wherein the one of said detector means further comprises a first and second pulse former stage connected between said comparator means and said oscillator means and said light receiver means respectively.

14. A system as set forth in claim 2, wherein said evaluation circuit means comprises flip-flop means having a set input connected to said second detector means, a clock input connected to said first detector means, and a flip-flop output for furnishing said alarm signal.

15. A system as set forth in claim 14, wherein said evaluation circuit means further comprises holding circuit means connected between said second detector means and said set input of said flip-flop means for storing said second detector output signal for a predetermined time interval following receipt thereof and applying the so-stored second detector output signal to said set input of said flip-flop means.

16. A system as set forth in claim 15, wherein said holding circuit means comprises a monostable multivibrator.

17. A system as set forth in claim 16, wherein said monostable multivibrator is a retriggerable monostable multivibrator.

18. An alarm system as set forth in claim 1, wherein said first detector means, said second detector means and said evaluation circuit means together constitute a first substation; wherein said alarm system further comprises a second substation and a central station; and wherein said central station comprises means for interrogating each of said substations and furnishing a first and second substation alarm signal in response to an alarm signal generated at said first and second substation respectively, and display means for displaying said first and second substation alarm signal if present.

19. A system as set forth in claim 18, wherein each of said substations comprises means for furnishing a full alarm signal for producing the alarm outside the building, an auxiliary alarm signal for producing the alarm inside the building, and a sabotage alarm signal to indicate sabotage to the substation, and means for transmitting said main alarm signal, said auxiliary alarm signal and said sabotage alarm signal to said main station in response to an interrogation signal; and wherein said means for interrogating said substations comprises means for periodically transmitting said interrogation signal to at least said first substation.

20. A system as set forth in claim 19, wherein said first substation further comprises means for furnishing an interrogation signal to said second substation a predetermined time interval following receipt of said interrogation signal from said central station.

21. A system as set forth in claim 20, wherein said means for furnishing said interrogation signal to said second substation comprises counting means for counting input pulses received at a counting input terminal when enabled and furnishing a counter output signal when the number of so-counted pulses is a predetermined number, and means connected to said counting means for transmitting said counter output signal to said second substation to constitute said interrogation signal.

22. A system as set forth in claim 21, wherein said first and second substations each comprises multiplexer means connected to said detector means and said counting means for transmitting said main alarm signal, said auxiliary alarm signal and said sabotage alarm signal to said central station in a predetermined sequence under control of said counting means.

23. A system as set forth in claim 18, wherein said interrogating mmeans comprises pulse generator means for furnishing a sequence of pulses, first counter means connected to said pulse generator means for counting said pulses and furnishing first counter output signals signifying the number of so-counted pulses, means for transmitting said pulses in said pulse sequence to said substations for synchronizing said substations to said central station, second counter means connected to said first counter means for receiving a selected one of said first counter output signals and furnishing a second counter output signal when the number of said selected first counter output signals is equal to the number of said substations, and logic circuit means connected to said first and second counter means for furnishing said interrogation signal upon simultaneous receipt of said first and second counter output signals.

24. A system as in claim 14, wherein said interrogating means comprises pulse generator means for furnishing a sequence of pulses, first counter means connected to said pulse generator means for counting said pulses and furnishing first counter output signals signifying the number of so-counted pulses, means for transmitting said pulses in said pulse sequence to said substations for synchronizing said substations to said central station, second counter means connected to said first counter means for receiving a selected one of said first counter output signals and furnishing a second counter output signal when the number of said selected first counter output signals is equal to the number of said substations, and logic circuit means connected to said first and second counter means for furnishing said interrogation signal upon simultaneous receipt of said first and second counter output signals.

25. A system as set forth in claim 19 or claim 24, wherein said central station further comprises means for receiving said main alarm signal, said auxiliary alarm signal and said sabotage alarm signal in said predetermined sequence and furnishing a corresponding received main alarm signal, received auxiliary alarm signal and received sabotage alarm signal under control of said first counter means, and storage means connected to said display means, said second counter means and said receiving means for energizing the corresponding one of said display means in response to said received alarm signals and said second counter output signals.

26. In a building having an interior and an exterior and at least one passage connecting said interior to said exterior, said passage having an interior side and an exterior side constituting, respectively, said first and second predetermined positions, said first predetermined position being at said exterior of said building and said second predetermined position being in the surroundings of said building, an alarm system for furnishing an alarm signal in response to unauthorized entry through said passage, comprising: first detector means located in the first predetermined position in said passage for sensing the presence of a person in operative vicinity of said first detector means and furnishing a first detector output signal in response to a so-sensed presence; second detector means located in a second predetermined position preceding said first predetermined position in the direction from said exterior to said interior of said building for sensing the presence of a person in operative vicinity of said second detector means and furnishing a second detector output signal in response to a so-sensed presence; and evaluation circuit means connected to said first and second detector means, for furnishing said alarm signal only if said second detector output signal is furnished prior to said first detector output signal, illuminating means for illuminating said exterior of said building, said light activating means connected to said illuminating means and said second detector means for activating said illuminating means in response to said second detector output signal, first alarm furnishing means for furnishing a first perceptible alarm in response to said alarm signal, and second alarm furnishing means connected to said second detector means for furnishing a second alarm perceptible only within said building in response to said second detector output signal.

27. An alarm system as set forth in claim 26, wherein said first detector means has a first predetermined sensitivity and said second detector means has a second predetermined sensitivity exceeding said first predetermined sensitivity.

28. A system as set forth in claim 26, wherein said evaluation circuit means is connected to said first and second detector means by at least one multiconductor cable; further comprising sabotage indicator means connected to at least one conductor in said multiconductor cable for furnishing a sabotage signal upon cutting of said conductor.

29. A system as set forth in claim 28, further comprising means connected to said second detector means and said sabotage indicator means for transmitting said sabotage signal to said evaluation circuit only upon prior receipt of said second detector output signal.

* * * * *